US006729969B2

(12) United States Patent
Fox

(10) Patent No.: US 6,729,969 B2
(45) Date of Patent: May 4, 2004

(54) GOLFING AID

(75) Inventor: Charles Nelson Fox, Belfast (IE)

(73) Assignee: DW Enterprises, LLC, Littleton, CO (US)

( * ) Notice: Subject to any disclaimer, the term of this patent is extended or adjusted under 35 U.S.C. 154(b) by 0 days.

(21) Appl. No.: 10/311,479

(22) PCT Filed: Mar. 13, 2002

(86) PCT No.: PCT/NZ02/00031

§ 371 (c)(1),
(2), (4) Date: Dec. 16, 2002

(87) PCT Pub. No.: WO02/072212

PCT Pub. Date: Sep. 19, 2002

(65) Prior Publication Data

US 2003/0176230 A1 Sep. 18, 2003

(30) Foreign Application Priority Data

Mar. 13, 2001 (NZ) ..... 510485

(51) Int. Cl.[7] ..... A63B 69/36
(52) U.S. Cl. ..... 473/280
(58) Field of Search ..... 473/280, 595, 473/422, 569; D21/707, 708

(56) References Cited

U.S. PATENT DOCUMENTS

| | | | | | |
|---|---|---|---|---|---|
| 665,671 | A | * | 1/1901 | Chapman | 273/113 |
| 1,833,531 | A | * | 11/1931 | Pearson | 273/129 R |
| 1,997,958 | A | * | 4/1935 | Wingard | 411/516 |
| 2,031,240 | A | * | 2/1936 | Van Deest | 473/595 |
| 2,151,030 | A | * | 3/1939 | Hinsen | 473/569 |
| 2,825,322 | A | * | 3/1958 | Burley et al. | 124/19 |
| 3,357,705 | A | * | 12/1967 | Blanchard | 473/280 |
| 3,918,720 | A | | 11/1975 | Gordos | |
| 4,153,248 | A | * | 5/1979 | Holmes et al. | 473/595 |
| 4,411,431 | A | * | 10/1983 | Judice | 473/200 |
| D317,805 | S | * | 6/1991 | Swan | D21/707 |
| 5,595,546 | A | | 1/1997 | Masters | |
| 5,743,808 | A | * | 4/1998 | Barth | 473/280 |
| 5,885,165 | A | | 3/1999 | Krause | |
| 6,443,863 | B1 | * | 9/2002 | Dinoffer | 473/595 |
| 2003/0176230 | A1 | * | 9/2003 | Fox | 473/280 |

* cited by examiner

*Primary Examiner*—Raleigh W. Chiu
(74) *Attorney, Agent, or Firm*—Patton Boggs LLP

(57) ABSTRACT

A golfing aid having a body that includes two partially spherical ends with the same radii as each other, whereby the contact points are positioned between 4 and 20 millimetres apart, and methods of producing and using such a golfing aid.

11 Claims, 6 Drawing Sheets

GOLFING AID

TECHNICAL FIELD

This invention relates to a Golfing Aid.

In particular, this invention relates to a golfing aid which provides visual feedback to the golfer about their golf stroke.

BACKGROUND ART

It is well known, that golf requires a great deal of practice. This practice involves a large amount of repetition of the fundamental aspects of the game. It is currently necessary to undertake large amounts of practice to become a competent golfer.

The need for practice is particularly true in relation to putting. Putting is the element of the game which can truly make or break a round. Bad putting, for example three-putting can ruin an entire hole regardless of how good the approach shots have been.

To become a better putter you need to strike the ball with a smooth motion. It is also necessary to address the ball correctly and maintain the putter head perpendicular to the line required. If any one of these elements is not right the putting stroke will be defective and result in the ball being mis-hit.

As putting is such an important part of the game golfers undertake large amounts of putting practice. This putting practice has traditionally been undertaken by repetitively hitting the golf ball across a surface towards a receptacle —generally a cup or a hole. A player develops a consistent stroke which allows them to hit the golf ball accurately only after large amounts of practicing this repetitive motion.

A large amount of practice is required, as this type of practice does not provide instant visual feedback to the golfer about their golfing stroke. Ideally there would be a golfing aid which would allow a golfer to instantly see how they are mis-hitting and incorrectly addressing the ball.

U.S. Pat. No's. 3,918,720, 4,278,254, 5,595,546 and 5,885,165 have all attempted to provide a solution to this problem in ways similar to the invention disclosed in this patent.

U.S. Pat. No 3,918,720 discloses a pair of balls that are spaced substantially apart. These balls are made from solid rubber and are not regulation golf balls. The balls are spaced apart by a rigid shaft that connects the two complete balls. This configuration means that if a golfer makes an inaccurate stroke premature contact with the surface of one ball the putting aid will roll in an arc with a large radius clearly indicating a mis-hit.

U.S. Pat. No. 4,278,254 discloses embodiments similar to '720. This patent allows for two or three complete balls to be attached by a central shaft projecting through the balls. The shaft protrudes through the outer skin of the outer balls.

There is an alternate construction for this patent which involves one golf ball having a pair of wheels attached to a shaft going through the middle of the golf ball, these wheels have a greater diameter than the golf ball. The wheels and golf ball are fixed together and roll as an integral unit. This product also if mis-hit causes the balls to roll in an arc with a large radius.

U.S. Pat. No. 5,595,546 is a putting aid comprising of two golf balls connected in an abutting relationship. These balls are connected by a threaded connector which extends into holes formed in the abutting surface of the golf ball. The threaded connector allows the golf balls to be affixed to each other and a relationship whereby the distance between the centres of the two golf balls is less than the length of the putter face. This also means the aid rolls in an arc if mis-hit.

U.S. Pat. No. 5,885,165 provides a putting aid which is similar to the '546 patent in that two balls are fixed together in an abutting relationship. However, this patent includes a pivotal assembly, as opposed to a threaded connector. This pivotal assembly allows the balls to rotate independently of each other, and therefore react more dramatically to an incorrect stroke.

Other aspects of the game are also critical to the completion of a successful round.

Golfers recognise that although putting has the potential to cause a player to drop the most shots it is necessary to have a complete game. A golfer needs to be able to drive a ball straight and long, and chip the ball accurately from shorter ranges.

A golfer needs to practice a full compliment of shots, however both chipping and driving practice takes a considerable amount of space. A golfer needs to either practice in a park or at a driving range.

In built up metropolitan areas this can often prove difficult as parks where a golfer is allowed to practice or driving ranges are not always readily accessible. This inaccessibility may be either due to location or the costs associated with commercial practicing ranges.

The inability of a number of golfers to practice in enough space to assess defects in their swing and contact with the ball hinders the development of their game. To rectify their inability to practice in the open a large number of golfers resort to practicing with hollow plastic balls. These plastic balls do not fly like regulation golf balls and therefore do not provide an accurate indication of the golfer's stroke. Further, the actual contact is not like that with a regulation golf ball, the forces involved are significantly less and thus does not allow a golfer to judge the weight necessary for a shot. These deficiencies result in a substandard practice session.

The prior art has a number of problems associated with it. Golf is very much a mental game. If a golfer gets out of a rhythm it can affect their game dramatically. Even minor changes in a golfer's psyche can result in several extra shots on their score card. Therefore, the object of a good golfing aid would be to enable practice to be as realistic as possible yet retain all the advantages of giving a clear indication of how the golfer has mis-hit their stroke.

Some of the prior art does not use real golf balls and therefore, cannot realistically reproduce the golfing situation or the realistic feel of striking a golf ball.

All of the prior art mentioned contains at least two completely spherical golf balls. The result of this is that while providing an indicator as to the problems associated with a putting stroke, the prior art does not adequately reproduce a realistic golfing situation. All of the prior art contains at least two balls which visually looks quite distinct from the single golf ball being putted under normal playing conditions.

Another problem associated with the prior art is that due to the presence of at least two complete golf balls there is a significant increase in weight. This significant increase in weight results in an artificial practice environment. If a golfing aid is at least twice as heavy as would be experienced under playing conditions the golfer will need to exert a significantly greater amount of force on the golf balls by hitting them harder. This in turn means that golfers are ill prepared when it comes to correctly weighting their shots which is as important in putting as correcting your swing and addressing of the ball to achieve the proper direction.

As all of the prior art contains at least two complete spherical golf balls the golfer needs to be a great deal more accurate if they wish to get the feeling of success by sinking the putting aid in either the hole, or receptacle they are using. This is particularly true if a golfer is practicing either chipping or driving. It is also a lot more difficult to sink a putting aid of this size, therefore the golfer will achieve a far lower success rate. This low success rate easily translates into frustration and the golfer is likely to give up practicing, thereby, not gaining the full benefit of the golfing aid.

The distance between the centres of the golf balls contained within the golfing aid corresponds to the difficulty to putt the golfing aid correctly. The further apart the centres of the golf balls used in the putting aid the harder it is to hit the golfing aid straight. Therefore, in the case of the prior art where the centres of the golf balls are spaced at least the diameter of a golf ball apart a golfing stroke will need to be virtually perfect for the golfing aid to be hit straight. This again results in a large amount of frustration on the part of the golfer which results in the golfer being more likely to give up and not use the golfing aid, thereby, not gaining the full benefit of the golfing aid.

The putting aids in the prior art contain at least two complete spherical golf balls attached together by some connecting means. These putting aids are large and cumbersome, and therefore do not fit conveniently in a golfing bag.

In addition to being cumbersome, the golf balls are independent therefore the connecting means could snap, thereby rendering the putting aid useless. There is a good chance of this happening, as putting aids are carried in golf bags, usually thrown in the back of a car or commonly subjected to other rough treatment, they are reasonably likely to break.

Further, the balls disclosed in the prior art are not sufficiently durable or strong to withstand the forces involved when the ball is chipped, let alone driven.

Another disadvantage of the similar prior art is the points on the golfing aid where contact is made is at least the diameter of an average ball apart. This distance translates to the golfing aid being very hard to hit correctly. If contact is only made with one ball the large forces are applied only to one 'half' of the putting aid. This force imbalance further frustrates the weakness is the linkage systems of the prior art, and will result in a large number of broken golfing aids.

Another disadvantage associated with the prior art is the distance between club face contact points are unable to be varied. The inability to adjust the distance between these contact points means a golfer cannot adjust the golfing aid to vary when they improve their swing, and therefore move to a harder setting.

Yet another problem with the prior art is that golf is played not only for the sport but also for social reasons. If a golfer wishes to practice on a real surface such as a green then he is likely to feel inadequate if he needs to use a golfing aid, particularly if it draws attention to itself. What is necessary is a golfing aid similar in appearance to a regulation golf ball. This would allow a golfer to use a golfing aid to give instant feedback on his stroke in relative anonymity.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a golfing aid having a body which includes two partially spherical ends with the same radii as each other, characterized in that the contact points of the golfing aid are positioned between 4 and 20 millimeters (0.16–0.79 inches) apart.

The body may come in a number of configurations. In some embodiments the body can be produced by injection moulding forming an integral golfing aid.

In preferred embodiments golf balls are machined and formed into an integral golfing aid. This golfing aid has partially spherical balls attached together.

In some embodiments the partially spherical ends may come in a number of configurations determined by the proportion of the sphere present.

In preferred embodiments the proportion of the original golf ball present is greater than the proportion not used.

In preferred embodiments the distal portions of the ends are spherical in addition to the main body of the ends. However it is envisaged that other geometrical shapes could fall within the definition of partially spherical. For example, it is envisaged that elliptical or partially conical distal portions can still be present while the main body of the ends are spherical leading the ends as a whole to be considered partially spherical.

Each partially spherical end's radii is to be the same. In preferred embodiments this radii to the tangents is the same as a regulation golf ball. It should, however, be understood that other radii are still within the ambit of this invention.

The longitudinal axis follows the line of elongation, and runs between the two extreme outer points (distal ends) of the golfing aid, those points which are furthest apart.

These contact points are defined as the two points which come into contact with a flat surface if the golfing aid is in a resting position.

An alternative definition of these contact points is the highest points of the golf ball in a resting position, i.e. where the longitudinal axis is approximately parallel with the flat surface or ground.

A further alternative method of defining the contact points is, they are the points of the golfing aid where the tangents of those points are parallel with the longitudinal axis of the golfing aid.

The longitudinal axis as defined above is the axis of elongation. The tangents of the golfing aid are positioned between 40 and 20 millimeters (0.18–0.79 inches) apart. It is this range which provides the greatest benefit over the prior art.

The optimum distance between the contact points varies depending on the stroke being practiced.

Examples of the preferred range of distances between the contact points for each golf points:

| Stroke Practiced | Optimal Contact Points Separation |
|---|---|
| Putting | 4–20 mm (0.16–0.79 inches) |
| Chipping | 5–8 mm (0.20–0.32 inches) |
| Driving | 5–8 mm (0.20–0.32 inches) |

This gap between contact points is the reason for the visual feedback. If the putter head is not perpendicular to the direction required one contact point will be struck first. The result of this means the ball travels in a curved path, veering off to the side, in the opposite direction to the side which contains the contact point which was struck first.

The golfing aid may have the dimples associated with a regulation golf ball, and those dimples may be in any configuration. However, it should, be understood the body of the golfing aid need not contain dimples, to fall within the scope of this invention.

In preferred embodiments the position of the dimples are such that the dimples are located so those contained on one half of the golfing aid reflect or mirror those of the other half.

This dimple alignment allows for a uniform ball surface to strike, ensuring a cleaner contact which translates into a more accurate identification of any swing defects. The dimple alignment also provides a more aesthetically pleasing product.

In some embodiments of the golfing aid the distance between the contact points is capable of being adjusted. For example the partially spherical ends may be slidably mounted on an internal coupling member.

An alternate construction may have the coupling member incorporating a screw thread enabling the distance between the contact points to be adjusted. The coupling member may also be a ratchet system. These examples are given by way of example only and it is envisaged that the adjustment mechanism may come in any suitable form.

According to another aspect of the present invention, there is provided a method of producing a golfing aid with contact points between 4 and 20 millimeters (0.16–079 inches) apart characterized by the following steps:

a) manufacturing a core for the golfing aid using injection molding techniques; and b) applying a resilient coating to the core. The density of the core of the injection molded golfing aid needs to be sufficient to enable the golfing aid to weigh approximately the same as a regulation golf ball. It should be appreciated that a golfing aid that has 20 mm (0.79 inches) separating the contact points will need a core material less dense than a golfing aid with just 4 mm (0.16 inches) separation.

In some embodiments the core material is manufactured from standard golf ball materials, which may include:

rubber, for example, elastomeric rubber polymers e.g. polybutadiene;

heavy cores, for example, tungsten; and liquid cores.

However, it should be understood that these examples should not be seen as limiting in any way, and the core material may take any suitable form.

In some embodiments the coating can include balata, elastomers, for example, urethane elastomer, titanium dioxide and ionomers, for example, Surlyn®, marketed by Du-Pont®. However, it should be understood that these are merely examples and the coating may take any suitable form.

In some embodiments the injection moulded core is made in a split mould.

In some embodiments the coating will cover the entire surface of the golfing aid. In other embodiments of the present invention it is envisaged that a band located between the contact points will be left uncoated.

In preferred embodiments the coating will contain dimples and an indicator line around the circumference of the middle of the ball. In preferred embodiments the dimples are mirrored on each half of the ball to provide an even surface to be struck by the club face.

It is envisaged that the coating can be made by dipping the core into the coating, or applied by injecting the coating material into the mould or by any other suitable means.

This injection moulding is particularly useful for producing balls destined to be used for chipping or driving practice.

Injection moulding has several advantages. Once the tooling is produced the golfing aids will be very cheap to produce and require minimal manual input. The injection moulded balls construction enables them to be very durable, and able to withstand the forces or either pitching, chipping or driving while retaining a long lifespan.

In preferred embodiments the golfing aid is manufactured from two golf balls.

According to another aspect of the present invention, there is provided a method of producing a golfing aid with contact points between 4 and 20 millimeters (0.16–0.79 inches) apart characterized by the following steps:

a) removing one face or portion from each of two golf balls to create a cut face;

b) creating an internal locating hole for a coupling member, one in each cut face;

c) inserting a coupling member into the locating hole; and d) affixing the two partially spherical ends of the golfing aid together.

The size of the portion removed in step (a) depends on the required distance between the contact points or tangents.

In preferred embodiments the process comprises a further step whereby a groove is formed around the circumference of the cut face, after step (a) has been undertaken. Preferably the groove created has a chamfered edge.

In preferred embodiments the locating hole created in step (b) is matched approximately to the size of the coupling member, which can be adjusted to vary the weight of the golf ball.

The coupling member referred to is may take any suitable form. The length and thickness of the coupling member may be varied enabling the weight of the golfing aid to be regulated and kept approximately the same as a regulation golf ball. In preferred embodiments the coupling member will be a dowel. In some embodiments the dowel will be hollow.

In preferred embodiments the dowel will contain barbs. These barbs may come in any suitable form, but include ribs, fingers or projections and the like capable of interacting, and gripping into the golfing aids core to 'lock' the two halves together.

In preferred embodiments the process comprises a further step whereby glue is applied to the cut face of the ball and also into locating hole.

The glue can come in any suitable form but in preferred embodiments it is an epoxy resin. When the two halves are placed to together any excess glue expelled from between the two faces is collected in the portion of the groove created by the chamfered edge.

An advantage of the present invention is the surface area exposed to the glue provides greater adhesion between the two halves of the golfing aid. This greater adhesion has the advantage that it reduces the effect of tortuous forces applied during a stroke. It also results in the lifespan of the golfing aid being increased.

In preferred embodiments the process comprises a further step whereby an indicator ring is located proximally to the join between the two halves, where the join is between the two contact points of the golfing aid. The indicator ring creates an indication line and can be made from plastic, aluminum, rubber and the like. In preferred embodiments it is created using plastic as plastic is more resilient.

In some embodiments the indication line is coloured. In other embodiments the indicator ring is integrally formed with the coupling member.

In embodiments of the present invention produced using injection moulding, a pigment may be added to the core material. This enables it to act as the indication ring, if no coating is present on a portion between the contact points of the golfing aid.

The indication line allows the golfer to correctly line up the direction of the stroke to ensure the direction of travel shown by the indication line is in fact perpendicular to the club head.

The indication line has the added advantage of allowing the golfer to line up the ball with the correct area of the head of the club. Not hitting the ball in the correct area can affect the performance and accuracy of the stroke.

As the golfing aid merely looks like a slightly elongated golf ball it has the advantage that it provides practice which appears real allowing the golfer to be mentally prepared for a normal game of golf. This is because the practice realistically mimics the standard game.

Visually the golfing aid disclosed does not differ greatly from a standard golf ball. This allows a golfer to practice putting on a green in a public course without obviously looking as though they are practicing. This allows for all the advantages of the golfing aid without the stigma attached to the prior art.

Another advantage over the prior art is weight. The ball is only marginally larger than a regulation golf ball. When manufactured a putting aid of this sort, due to its dimensions is the same or substantially the same weight as a regular golf ball. This reduction in weight difference allows a golfer when practicing putting to get a better feel for the effort required for a shot. This improves their putting as the weighting of a shot is as important as the line. Therefore, the present invention is significantly better than the prior art in this respect.

A further advantage is that as the golfing aid is significantly closer to the size of a regulation ball the golfer practicing their putting will undertake a successful putt more often. This is due to sheer mechanics, in that there is greater room for error in the line of the shot while still enabling it to sink a putt, as the putting aid is smaller.

A further advantage is when the ball is being chipped or driven it gives an indication of the golfers stoke immediately after it is stuck. The golfing aid if hit with an incorrect stoke deviates from its normal trajectory very early in it flight. This enables a golfer practicing driving or chipping into a net to observe defects in their stoke before the golfing aid reaches the net. This means that a golfer will no longer have to practice in a park or at the driving range to observe defects in their stoke.

Another advantage of the golfing aid disclosed over the prior art is ease of use. It has been found that, as the contact points of the golfing aid move further apart, the ball becomes progressively harder to hit correctly. At this minimum separation of 4 mm (0.16 inches). the ball is comparable to a regulation golf ball and minimal visual feedback is provided. At the outer limits of 20 mm (0.79 inches). the ball becomes very difficult to hit correctly. Therefore, in the prior art whereby the balls are spaced at least the diameter of of a golf ball apart, approximately 5 cm (2 inches), the putting aid would be nearly impossible to hit correctly. Therefore, there is a greater chance with the decreased spacing between the contact points that a golf will continue to use the golfing aid, thereby gaining the full benefit from its use.

A further advantage over the prior art is that a golfer can progress through different levels of difficulty. For example, a beginner may start using a putting aid with a 5 millimeter (020 inches) spacing between the contact points. Upon mastering this size, they could progress to, for example, a 7 millimeter (0.28 inches) spacing, and so on. Therefore, a golfer can pick a golfing aid which corresponds to their level of skill. The ability of some embodiments of the present invention to be adjusted further compounds this advantage. One golfing aid can, therefore, enable a golfer to hone their skills regardless of their playing ability. When the golfer's stroke improves, the golfing aid can simply be adjusted to a harder level.

In preferred embodiments the golfing aid will be one integral body. This results in a smaller less cumbersome golfing aid.

It also will reduce the chance of the golfing aid breaking. This has advantages over the prior art in that the golfing aid is transported more conveniently. Also, as a result of being one integral body is likely to have a greater life expectancy, and durability.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
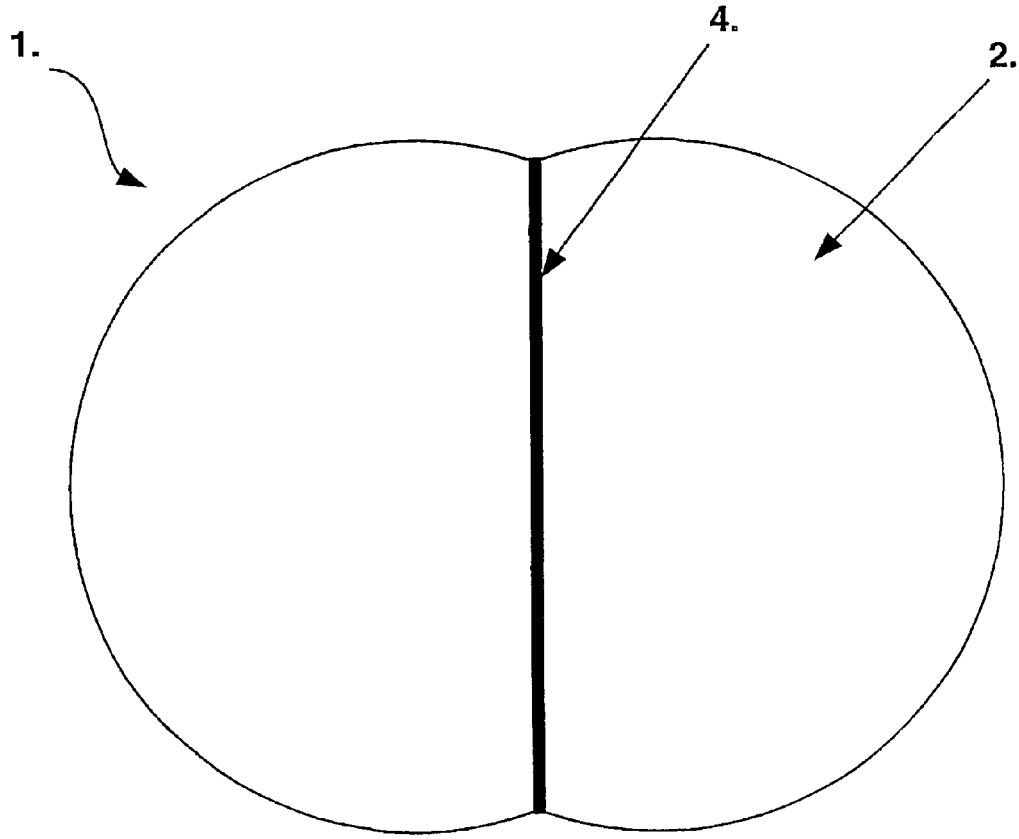
FIG. 1 Shows a plan view of the golfing aid.

In FIG. 1, there is provided a golfing aid generally indicated by arrow 1, the golfing aid (1) includes two partially spherical ends (2) which are formed into an integral body. An indicator line (4), is created around the circumference of between the two contact points of the golfing aid.

Figure 4:
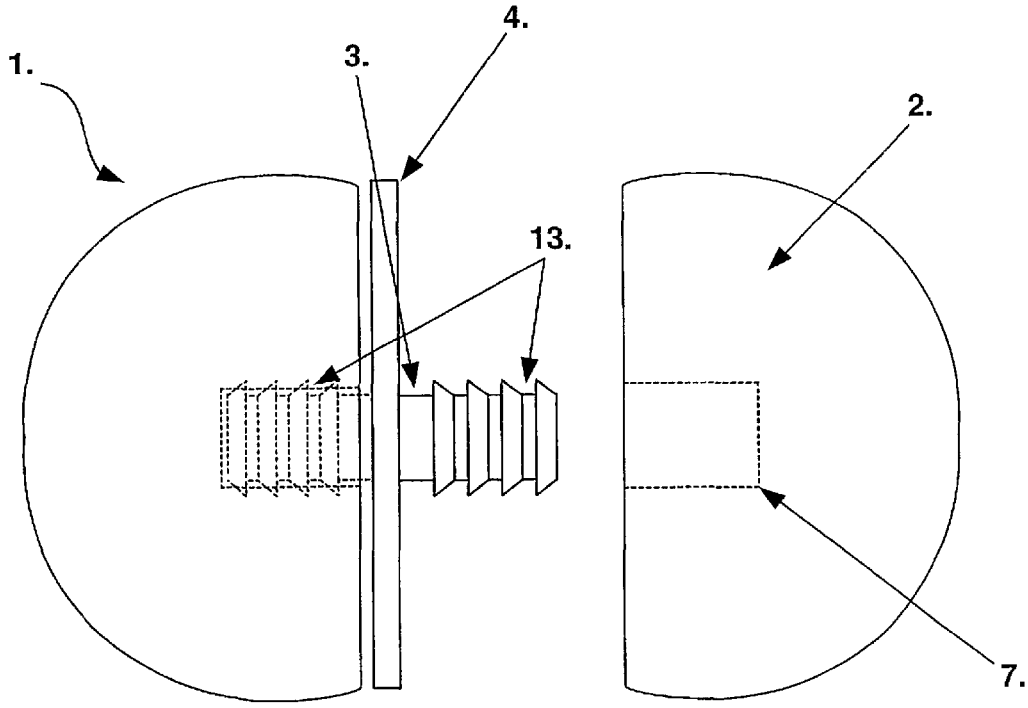
FIG. 4 Shows one embodiment of the components of a golfing aid.

In FIG. 4 the partially spherical ends (2) are formed from golf balls which have had a portion machined off them, leaving a partial golf ball.

The two machined balls then have a groove with a chamfered edge (6) cut around the circumference of the cut face. A locating hole (7) is then created by drilling a hole into the cut face of each ball. Glue is applied to the cut surface, and into the locating hole. An internal dowel (3) is then placed into the locating hole. This dowel is barbed, these barbs (13) enabling the dowel to grip into the balls core, and contains an integral indicator ring. The two balls are then attached together to form the integral body of the golfing aid. The indicator ring located in the join between the two golf balls creates an indicator line (4).

The indicator line (4) allows the golfer to correctly line up the direction of travel. It also enables the golfer to strike the golfing aid (1) in the correct area of the club head (5).

Figure 3:
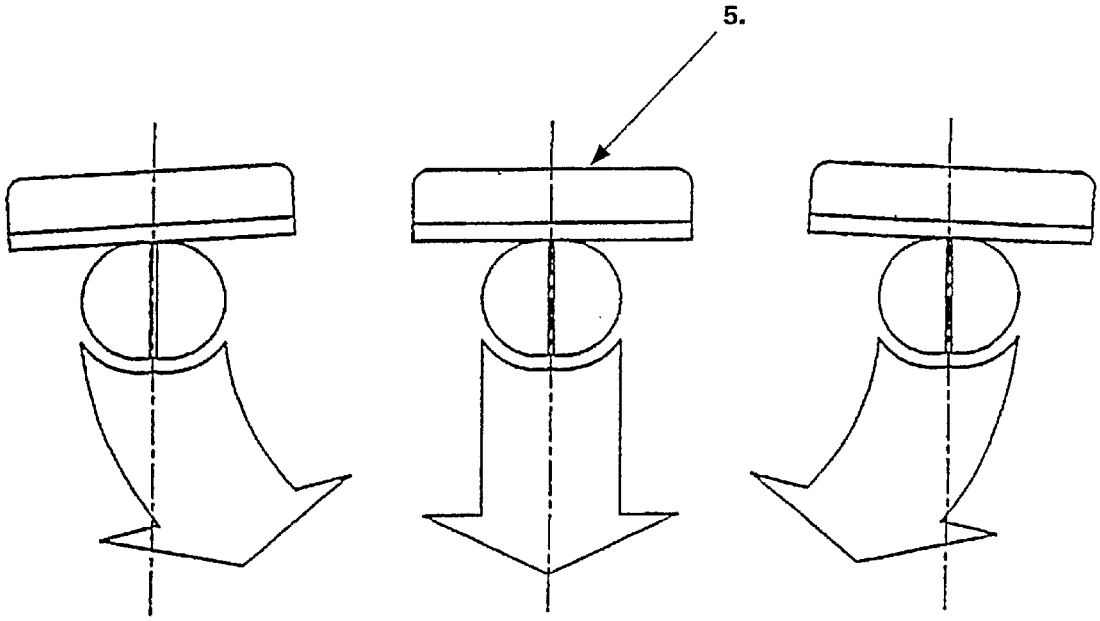
FIG. 3 Shows the operation of the golfing aid.

FIG. 3 shows how the golfing aid (1) is used to correct a putting stroke. If the golfing aid (1) is incorrectly hit by not having the putter head (5) perpendicular to the indicator line (4) then the putting aid (1) will veer off to one side, as shown. The same principle applies to chipping and driving.

Figure 2:
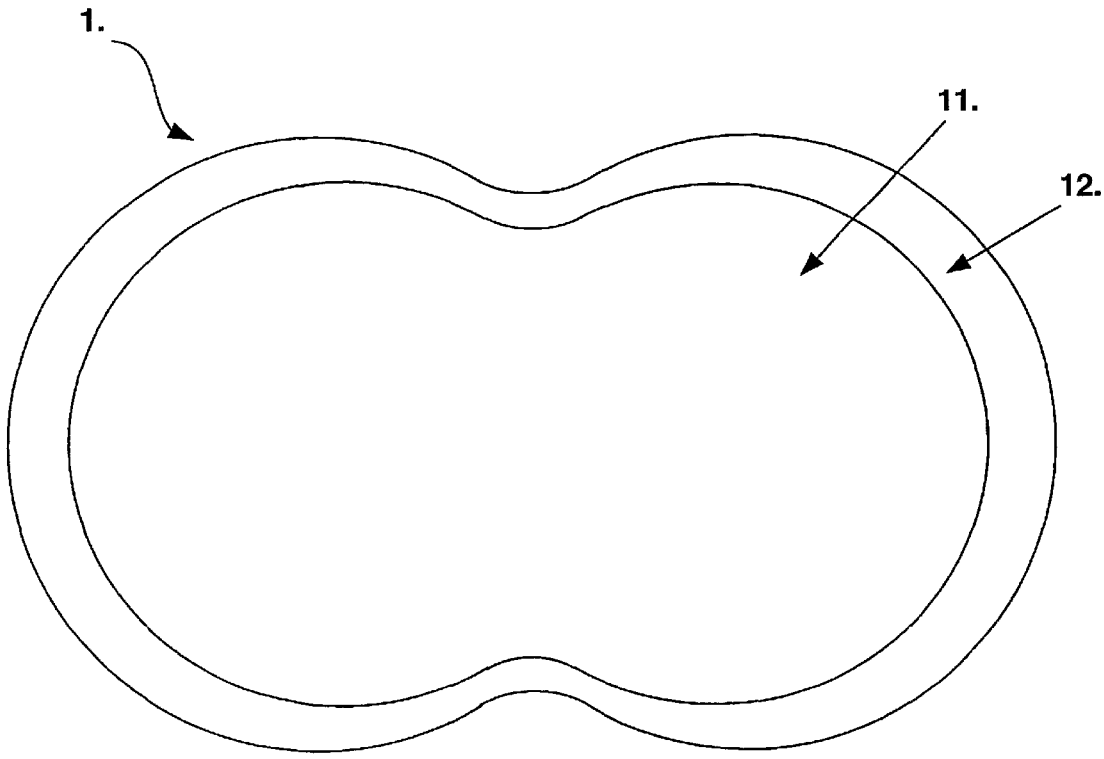
FIG. 2 Shows a plan view of an alternative embodiment of the golfing aid.

FIG. 2 shows one embodiment of the golfing aid (1) produced by injection moulding, including a core (11) made from elastomeric rubber and coating (12) made from Surlyn®. The injection moulded ball's core (11) is made using a split mould, the coating (12) is then moulded directly onto the core (11). The coating contains dimples arranged so one half mirrors the other half.

Figure 5:
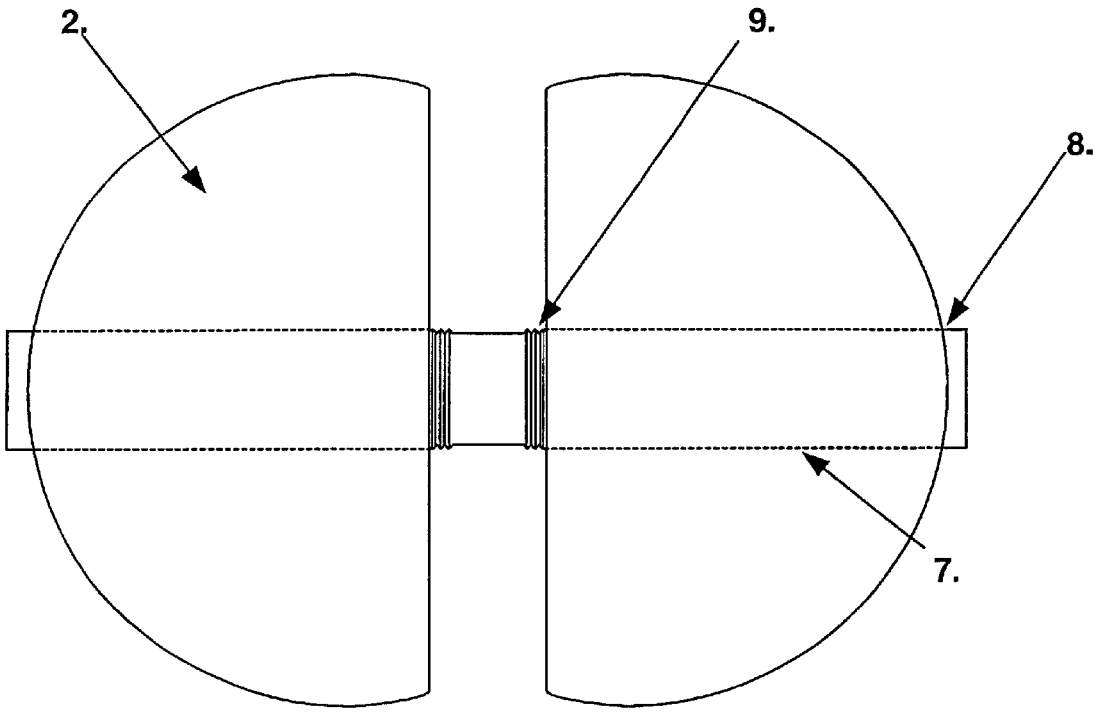
FIG. 5 Shows a plan view of an alternative embodiment of the golfing aid.

FIG. 5 depicts and alternative embodiment of the golfing aid which can be adjusted to vary the distance (distance "x" from FIG. 6) between the two contact points (10). It has a central sleeve (8) is housed within the locating hole (7). The central sleeve (8) frictionally assists the connection of the two partially spherical halves (2). The central sleeve (8) contains adjustment markings (9) to enable the golfer to determine the distance between the contact points (10).

Figure 6:
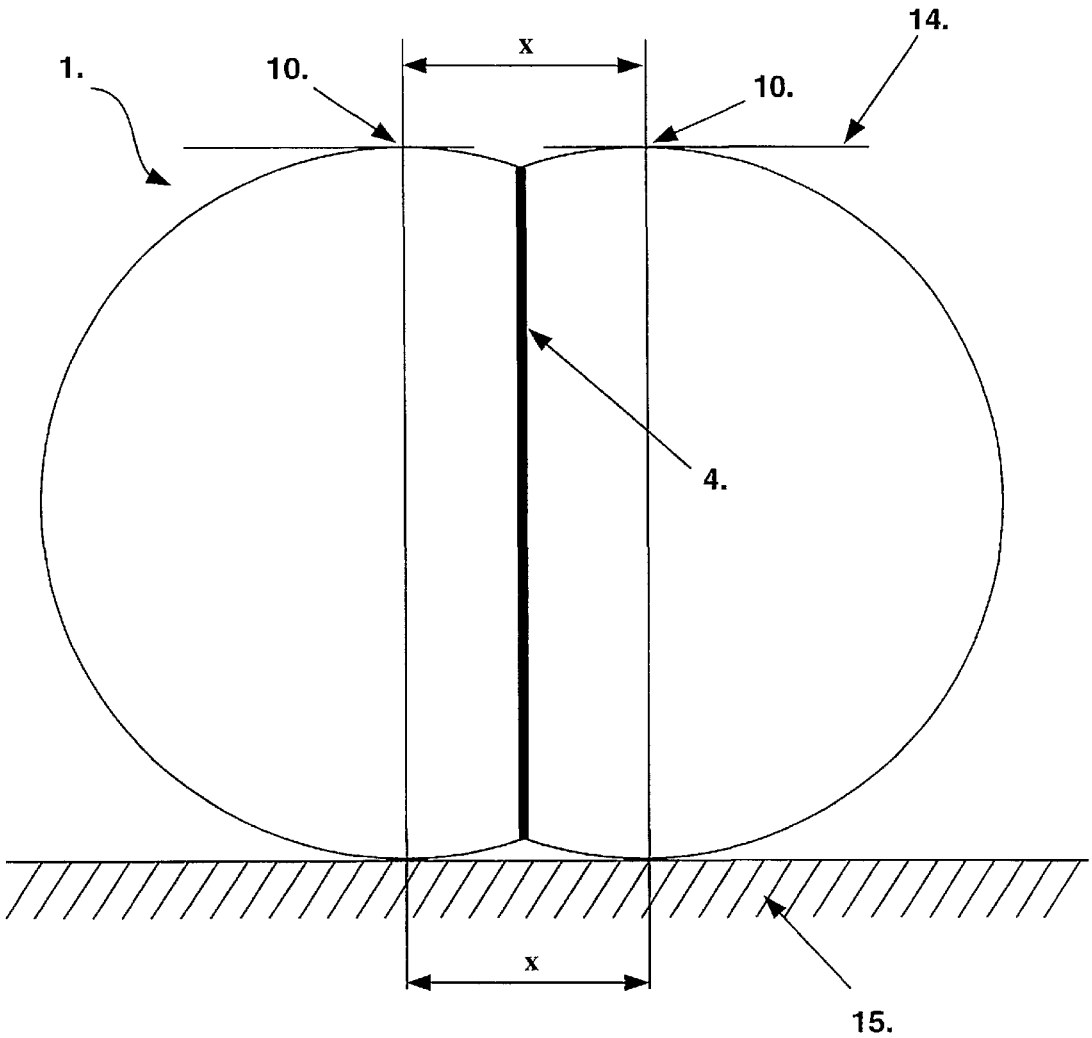
FIG. 6 Shows a graphical representation of the distance between the contact points.

FIG. 6 shows the golfing aid, and the position of the tangents (14) and contact points (10) and the ball in a resting position on a flat surface (15). The distance "x" represents the distance between the contact points (10), which is between 4 and 20 millimeters (0.16–0.79 inches).

Aspects of the present invention have been described by way of example only and it should be appreciated that modifications and additions may be made thereto without departing from the scope of the appended claims.

We claim is:

1. A golfing aid having a body which includes, two partially spherical ends with the same radii as each other, wherein the contact points of the ends of the golfing aid are positioned between 4 millimeters (0.16 inches) and 20 millimeters (0.79 inches) apart said golfing aid further including an indication ring between said contact points.

2. A golfing aid as in claim 1 where the distance between the contact points is between 5 millimeters (0.20 inches) and 8 millimeters (0.32 inches).

3. A golfing aid as in claim 1 where the distance between said contact points is adjustable.

4. A golfing aid as in claim 1 that includes dimples on its surface, that are located so that one half of said golfing aid mirrors the other half.

5. A method of practicing a golf stroke using a golfing aid, said method comprising:

providing a golfing aid comprising a first partial sphere and a second partial sphere, said first and second partial spheres each having the same radius and comprising a sphere portion greater than a hemisphere, said partial spheres adjoining each other along a circular chord and sharing a common axis; and striking said putting aid with a golf club.

6. A method of teaching, or tutoring a golf stroke using a golfing aid, said method comprising:

providing a golfing aid comprising a first partial sphere and a second partial sphere, said first and second partial spheres each having the same radius and comprising a sphere portion greater than a hemisphere, said partial spheres adjoining each other along a circular chord and sharing a common axis; and instructing a golfer or prospective golfer to strike said golfing aid with a golf club.

7. A method claimed in claim 6 where said golf stroke is selected from the group of putting, chipping or driving.

8. A golfing aid comprising a first partial sphere and a second partial sphere, said first and second partial spheres each having the same radius and comprising a sphere portion greater than a hemisphere, said partial spheres adjoining each other along a circular chord and sharing a common axis.

9. A golfing aid as in claim 8 wherein each of said partial spheres includes a contact point where the tangent to the sphere is parallel to said common axis, and said contact points of partial spheres are positioned between 4 millimeters (0.16 inches) and 20 millimeters (0.79 inches) apart.

10. A golfing aid as in claim 8 and further including an indication ring located proximal to said circular chord where said partial spheres adjoin.

11. A golfing aid as in claim 8 and further including an internal coupling member extending into each of said first and second partial spheres.

* * * * *

UNITED STATES PATENT AND TRADEMARK OFFICE

CERTIFICATE OF CORRECTION

PATENT NO. : 6,729,969 B2
DATED : May 4, 2004
INVENTOR(S) : Charles Nelson Fox

It is certified that error appears in the above-identified patent and that said Letters Patent is hereby corrected as shown below:

Column 4,
Line 49, delete "between 40 and 20 millimeters (0.18 - 0.79 inches) apart. It" and insert -- between 4 and 20 millimeters (0.16 - 0.79 inches) apart. It --

Signed and Sealed this

Twenty-first Day of December, 2004

JON W. DUDAS
*Director of the United States Patent and Trademark Office*